US007362239B2

(12) United States Patent
Franczyk et al.

(10) Patent No.: US 7,362,239 B2
(45) Date of Patent: Apr. 22, 2008

(54) VEHICLE WARNING SYSTEM

(75) Inventors: Frank M. Franczyk, Winnipeg (CA); James D. Vanstone, Winnipeg (CA)

(73) Assignee: Persen Technologies Incorporated, Winnipeg, CA (US)

( * ) Notice: Subject to any disclaimer, the term of this patent is extended or adjusted under 35 U.S.C. 154(b) by 213 days.

(21) Appl. No.: 11/141,395

(22) Filed: Jun. 1, 2005

(65) Prior Publication Data

US 2005/0264404 A1 Dec. 1, 2005

Related U.S. Application Data

(60) Provisional application No. 60/575,382, filed on Jun. 1, 2004.

(51) Int. Cl.
*G08G 1/01* (2006.01)

(52) U.S. Cl. ..... 340/936; 340/466; 340/905; 340/995.27

(58) Field of Classification Search ..... 340/988, 340/995.1, 995.27, 901, 466, 905, 936; 342/20, 342/22

See application file for complete search history.

(56) References Cited

U.S. PATENT DOCUMENTS 4,903,212 A * 2/1990 Yokouchi et al. ..... 701/216
5,225,842 A 7/1993 Brown et al.
5,315,295 A * 5/1994 Fujii ..... 340/936
5,497,149 A 3/1996 Fast
5,515,042 A 5/1996 Nelson
5,819,198 A * 10/1998 Peretz ..... 701/117
5,848,373 A 12/1998 DeLorme et al.
5,916,300 A 6/1999 Kirk et al.
5,977,884 A 11/1999 Ross
6,118,403 A 9/2000 Lang
6,177,905 B1 1/2001 Welch
6,252,544 B1 6/2001 Hoffberg
6,265,989 B1 * 7/2001 Taylor ..... 340/901
6,400,304 B1 6/2002 Chubbs, III
6,401,068 B1 * 6/2002 Cherveny et al. ..... 704/275
6,462,675 B1 * 10/2002 Humphrey et al. ..... 340/905
6,515,596 B2 * 2/2003 Awada ..... 340/905
6,594,614 B2 * 7/2003 Studt et al. ..... 702/150
6,670,905 B1 12/2003 Orr
6,675,085 B2 * 1/2004 Straub ..... 701/93
6,690,291 B1 * 2/2004 Cardillo et al. ..... 340/901
6,720,889 B2 * 4/2004 Yamaki et al. ..... 340/933

(Continued)

FOREIGN PATENT DOCUMENTS

CA 2195591 1/1997

(Continued)

*Primary Examiner*—Brent A. Swarthout
(74) *Attorney, Agent, or Firm*—Ryan W. Dupuis; Adrian D. Battison; Michael R. Williams

(57) ABSTRACT

A vehicle warning system is responsive to vehicle speed and position as determined by GPS or other location based system information to alert a vehicle operator of potentially unsafe conditions when either exceeding the speed limit on a given road segment or when approaching coordinates of a designated location alert point. The system comprises a portable device, a simple device personalization process using a single physical data communications interface to a local computing device connected to the Internet, and a remote server with a segmented database that provides access to common data services, positional data updates, and device personalization functionality.

20 Claims, 4 Drawing Sheets

U.S. PATENT DOCUMENTS

| | | | | |
|---|---|---|---|---|
| 6,748,322 | B1 * | 6/2004 | Fernandez | 701/213 |
| 2002/0020090 | A1 * | 2/2002 | Sanders | 40/447 |
| 2002/0126038 | A1 * | 9/2002 | Kroculick | 342/20 |
| 2003/0060232 | A1 * | 3/2003 | Hashimoto et al. | 455/556 |

FOREIGN PATENT DOCUMENTS

| | | |
|---|---|---|
| CA | 2150942 | 7/1999 |
| CA | 2288475 | 11/1999 |
| CA | 2423974 | 9/2001 |
| WO | 98/32105 | 1/1998 |
| WO | 98/59256 | 6/1998 |
| WO | 01/55744 | 1/2001 |
| WO | 01/73466 | 4/2001 |
| WO | 02/01484 | 6/2001 |
| WO | 02/023507 | 9/2001 |

* cited by examiner

VEHICLE WARNING SYSTEM

This application claims priority under 35 U.S.C.119 from U.S. Provisional Application Ser. No. 60/575,382 filed Jun. 1, 2004.

FIELD OF THE INVENTION

The present invention relates to a vehicle warning system which responds to speed and position of the vehicle determined by Global Positioning System information, to alert an operator of the vehicle of potentially unsafe conditions, for example exceeding the speed limit. The system includes a remote server having a segmented database to provide updates and personalization functionality.

BACKGROUND

Road safety is a key public health issue in society. Unintentional injuries resulting from road traffic accidents are the number one cause of death in the 1 to 34 age group. Such accidents occur each day with as many as 140,000 people injured on the world's roads, more than 3,000 deaths, and over 15,000 people disabled for life (WHO-2001). Vehicular crashes happen in a split second. Sometimes they are avoidable, sometimes they are not. Four key factors in vehicular collisions include the road conditions, the weather, the vehicle itself, and most importantly, driver skill. The driver's skill, attentiveness, and judgment play a key role, and the speed of the vehicle is most important in determining the severity of the crash.

When a driver is distracted, tired, or under the influence of drugs or alcohol, they are less likely to react as quickly or safely to driving situations. Driving requires the driver's undivided attention so that they can react to any driving situation, especially when they don't know the skill level or the emotional condition of other drivers on the road. If the driver is not paying attention to their own driving or the driving of the others, the slightest mistake can prove costly. Driving at speeds that exceed the posted speed limit accentuate the potentially hazardous situation that may result if corrective action is not taken. The repercussions from speeding and collisions include fines, increased insurance premiums, and demerit points that result in increased driver-licensing fees. Governments know that money is a key motivator to reduce speeding and to avoid collisions, and the cost of being caught speeding or having an accident continues to rise.

Local road safety initiatives are commonly implemented to reduce accidents and injuries resulting from drivers of vehicles who speed within community school zones and parks. In certain municipalities, photo radar and Red Light Camera (RLC) technology is used as a means to enforce traffic safety laws, particularly speeding and red light running. This helps reduce dangerous driving behaviour and benefits the community by reducing speeding and collisions. Locations of such photo detection systems are visible within the general community via road signs, and are accessible on the Internet on municipal police web sites. Such access to information is provided to increase an individual's awareness of the RLC locations. The responsibility of noting such signage or of seeking out the information from the municipal police department websites is the responsibility of the individual. Individuals also have the choice of being more attentive to the signage, noting such information in their own memory or on paper maps, or programming their laptops or GPS navigation systems.

Portable GPS receivers capable of programming waypoint (points of interest) markers is one alternative that can be used for the purpose of making note of RLC locations based on latitude and longitude coordinates. Most GPS receivers can also calculate and display vehicle speed through a LCD (Liquid Crystal Display) or LED (Light Emitting Diode) display. Visual displays requiring driver attention can distract a driver of a vehicle from watching the road ahead, and may result in an unsafe driving environment. Such devices may violate the AMA (Alliance of Automobile Manufacturers) "2/20 requirement" for telematics devices installed in vehicles (20 seconds of visual attention to complete assessment/interpretation of information presented from telematics device, of which no single glance shall be longer than 2 seconds). Such map-based navigational systems are also complex to use and program and are relatively expensive.

There are various prior art devices which relate generally to vehicle information systems. CA 2,150,942 (Kao) discloses a map data based position correction for a vehicle navigation system. The system uses a map database and the GPS system to determine the location of a vehicle on freeways or rural highways.

U.S. Pat. No. 6,118,403 (Lang) discloses a speed trap information system that provides information to authorized users regarding the location of speed traps via a wireless communication network connected to a computer wide area network. The system includes the use of a detector for speed detecting equipment, such as a radar detector, which detects the presence of speed detecting equipment and transmits the detection information into an electronic device in the motor vehicle. The electronic device communicates to a physical location device, such as a GPS receiver, which provides the specific location and direction of the motor vehicle when detection occurs. The electronic device is also coupled to a wireless modem that connects to a wireless communication network and to the wide area network. Connected to the wide area network is a central server that receives uploaded information from a plurality of other motor vehicle operators to create a large information database. Authorized users are then able to log into the central server and download information regarding the location of the speed detecting equipment operating in a specific roadway U.S. Pat. No. 6,177,905 (Welch) discloses a location-triggered reminder for mobile user devices. The mobile user device, such as a personal digital assistant, a wireless telephone, a car phone, or any other programmable device that the user generally has with him or her, is equipped with a global positioning system (GPS) receiver and is programmable by the user to alert the user to when he or she arrives with the device at a predetermined location, as well as to disclose to the user whatever information the user chose to associate with that location (e.g., a "to-do" list).

U.S. Pat. No. 5,497,149 (Fast) discloses a global security system for determining the position of an object to be protected using a local or global positioning system and issuing messages to a monitoring message center at predetermined times and/or at times when the object to be protected is under an alert condition, such as being outside an allowed position zone during a defined time period.

U.S. Pat. No. 5,848,373 (DeLorme et al.) discloses a computer aided map location system (CAMLS) which provides correlation and coordination of spatially related data between a computer (PDA/PC/EC) and a set of printed maps typically printed on paper depicting surface features at desired levels of detail. A first set of constant scale printed maps substantially coincides with or is overprinted with equal area grid quadrangles of a first scale grid. The first scale grid quadrangles are identified by a first set of unique names. The PDA/PC/EC has a computer display or other computer output, a first database, and display subsystem. The first database includes the first set of unique names of the grid quadrangles of the first scale grid. The boundary lines of the respective first scale grid quadrangles are identified in the first database by latitude and longitude location. The display subsystem causes the display of a selected grid quadrangle or gridname on the PDA/PC/EC display in response to a user query. The displayed grid quadrangle or gridname is correlated with a grid quadrangle of a printed map from the first set of printed maps. The PDA/PC/EC may have access to a second database or multiple databases of latitude and longitude locatable objects (loc/objects) for display on selected grid quadrangles. Alternatively or in addition the PDA/PC/EC may incorporate a user location system such as a GPS location system for displaying the location and route of the CAMLS user on the display. Multiple level scales of grids and corresponding multiple sets of maps at the different scales are available. Communications links are provided between CAMLS computers and CAMLS users in various combinations U.S. Pat. No. 5,225,842 (Brown et al.) discloses a vehicle tracking system employing global positioning system (GPS) satellites which provides extremely accurate position, velocity, and time information for vehicles or any other animate or inanimate object within any mobile radio communication system or information system, including those operating in high rise urban areas. The tracking system includes a sensor mounted on each object, a communication link, a workstation, and a GPS reference receiver. The sensor operates autonomously following initialization by an external network management facility to sequence through the visible GPS satellites, making pseudo range and delta range or time difference and frequency difference measurements. No navigation functions are performed by the sensor, thereby permitting significant reductions in the cost thereof. The raw satellite measurements, with relevant timing and status information, are provided to the communication link to be relayed periodically back to the workstation. Differential corrections may also be provided at the workstation to increase the accuracy of the object location determination. In normal operation, three satellite measurements are required to compute the location of the object, but for a short time period a minimum of two satellite measurements are acceptable with time, altitude, and map aiding information being provided by the workstation.

U.S. Pat. No. 6,400,304 (Chubbs, III) discloses an integrated GPS radar speed detection system in which a global positioning satellite system (GPS) and a radar detection unit, in wireless communication with the GPU, are used for tracking and determining the speed of a vehicle. The system may be manually activated, or more preferably activated by an external source of radar signals, such as may be emitted by a police "speed trap". The unit includes means for recording and storing speed data of the vehicle, and to alerting the operator of the vehicle to a "speed trap" situation U.S. Pat. No. 5,916,300 (Kirk et al.) discloses a method and an apparatus for automatic event detection and processing. A positioning system receiver includes a position measurement device and a logging device. The position measurement device is configured to receive and process signals from a positioning system. The logging device is coupled to the position measurement device for recording data received from the position measurement device. The logging device records the data at a current logging rate. The positioning system receiver detects an event via an external sensor or with reference to satellite data, for example. In response to the event, the logging device automatically modifies data logging processing such as the current logging rate. Additionally, to allow a post processing system to go backwards in time relative to the event, the current logging rate may be increased for a predetermined amount of time preceding the occurrence of the event. According to another aspect of the invention, the data logging processing of a survey system, such as a real-time kinematic (RTK) system including a base reference station and a roving unit, may be altered based upon an event. Positioning system data is received. A first subset of the positioning system data is recorded prior to the event being detected. The first subset of positioning system data may include real-time roving unit position solutions. If the event has been detected, a second subset of the positioning system data is recorded. The second subset of the positioning system data may include data used for post processing.

A warning device available by Cyclops UK Limited, under the trade name Cyclops and described at www.cyclops-uk.com, makes use of GPS information to detect location of a vehicle in relation to one of a plurality of designated trigger positions. Each trigger position corresponds to a given location defined by GPS coordinates and includes a speed limit associated therewith. An operator warning is activated when the vehicle approaches one of the trigger positions. A more severe operator warning is activated if the vehicle is exceeding the speed limit associated with the trigger position being approached. The device is limited in its use in that its database only includes data related to photo radar locations and the speed limit at those specific locations. No information is provided with regard to complete road segments, but only limited information as to specific locations are provided in the database. As no roadways are provided in the database, the device is of little use for tracking overall safe travel of a vehicle along various roadways which do not include photo radar devices.

SUMMARY OF THE INVENTION

According to one aspect of the invention there is provided a vehicle warning system responsive to speed and position of the vehicle, the system comprising:

an antenna subsystem for capturing location based information system signals;

a radio frequency processing subsystem which is arranged to receive the signals from the integrated antenna subsystem to determine a current position and a current velocity of the motor vehicle;

a local data storage including location alert points and road segment representations with speed data associated therewith, the location alert points each being representative of a given location, and the road segment representations with speed data associated therewith each being representative of an actual road segment and a speed limit for the actual road segment;

a processor which is arranged to compare the current position and the current velocity determined by the radio frequency processing subsystem to the local data storage to determine an alarm condition if the current position approaches a location alert point or if the current position corresponds with one of the road segment representations and the current velocity exceeds the speed data associated therewith;

an indicator to alert an operator of the motor vehicle of the alarm condition;

a power supply for supplying electrical power to the system; and a communication processing subsystem arranged for connecting the local storage data to a remote server to update the local data storage.

The present invention provides a non-intrusive, simple, easy-to-use, and affordable solution that can inform the operator of a motor vehicle of the speed limit on any road segment within the designated municipal coverage area and not just at specified locations. The system can alert the operator if the speed limit is being exceeded at any position along a database of complete road segments and in addition when the operator approaches a potentially hazardous location including pedestrian crosswalks, red light camera (RLC) intersections, school zones, and other potentially unsafe locations as defined by the local municipalities regardless of speed of the vehicle. The system is not distracting and can be easily updated and configured by the operator according to the operator's preferences and requirements. The benefits from such a system and solution are both numerous and significant, and include greater personal and community safety, financial savings from avoiding red light camera fines, savings in potential driver and vehicle insurance premium penalties, the avoidance of increased licensing fees resulting from speeding and collisions, and greater peace of mind through an increased awareness of the driving environment.

Preferably, the location alert points have no speed data associated therewith and each road segment representation is defined as two endpoints and a width.

The local data storage preferably includes a plurality of continuous and intersecting road segment representations which represent substantially all of the actual road segments within a prescribed area, or which represent substantially all actual road segments within the prescribed area having a posted or a legislated speed limit associated therewith.

The remote server may include a plurality of coverage areas, each coverage area comprising a plurality of road segment representations which are representative of substantially all actual road segments in a prescribed municipal area and wherein the communication processing subsystem permits a user to select which coverage area is stored in the local data storage.

The communication processing subsystem may also permit a user to select which location alert points, among a database of location alert points of the remote server, are updated to the local data storage.

There may be provided a plurality of types of indicators including visual, audio or combinations thereof, for example different colours of LED lights may be provided. The communication processing subsystem preferably permits a user to select which type of indicator is associated with each alarm condition.

The speed data preferably comprises a speed limit and an allowance range exceeding the speed limit and wherein the processor only determines an alarm condition if the current velocity exceeds the speed data including the allowance range, the allowance range being adjustable.

The communication processing subsystem is preferably arranged to connect to a computing device connected to the Internet or to connect directly to the Internet to access the remote server. The remote server in this instance may include a segmented database to provide for local data storage update and to provide for personalization and configuration of various system settings.

The remote server preferably includes a remote server application software tool that processes operator requests by automatically authenticating the communication processing subsystem through a connection management service that cross-references an electronic serial number of the system and validates registration and common data services subscription for local data storage updates and personalization.

There may be provided a user log subsystem which records a log of travel of the vehicle and alarm conditions, the user log subsystem being arranged to permit a user to transfer the log in a form of position and time related data to a personal software application for mapping and reporting statistics.

The communication processing subsystem may be arranged to initiate, receive, and operate in a mobile, real-time manner using wireless techniques including one of licensed analog FM (Frequency Modulation) frequencies, licensed digital radio frequencies, and licensed and unlicensed Wireless-Fidelity (Wi-Fi) and Wi-MAX frequency spectra.

There may be provided a user input for interrogating the local data storage for the speed limit associated with a road segment representation with which the current position corresponds with.

The indicator may include a primary speaker and an auxiliary output for connection to an auxiliary speaker to alert the operator of the motor vehicle of the alarm condition if the primary speaker is not loud enough in certain environments.

Preferably a photocell is used for determining ambient light condition with the indicator including a light having a brightness which is in response to the ambient light condition determined by the photocell.

The power supply may be arranged to be disconnected in response to the current position remaining unchanged for an elapsed period of time.

The antenna subsystem, the radio frequency processing subsystem, the local data storage, the processor, the indicator, the power supply, and the communication processing subsystem are preferably contained within a common portable housing.

According to a further aspect of the invention there is provided an apparatus comprising:

a position and velocity indication device, operable by an operator to provide the operator with information about their driving environment, comprising:

a plastic enclosure;

a battery compartment for two standard AA-sized batteries;

a row of LEDs for displaying colored lights to the operator;

a photocell for adjusting the LED output intensity;

an integrated loud speaker;

an audio output for supplying audio and voice communications to the operator;

an audio output connector for supplying audio to an external loud speaker;

a manual control input for control by the operator;

a network connection for connection to the network;

an integrated transducer/resonator antenna subsystem in the housing;

the antenna subsystem being an integrated PCB design to capture current and future GPS, Galileo, and Location Based Information system signals;

an RF processing subsystem being arranged to receive the location based signals from the antenna subsystem;

the RF processing subsystem being comprised of elements used to select, amplify, and filter the desired system frequencies;

a digital processing subsystem used to extract the communications protocols from the demodulated RF subsystem frequencies to determine the position and velocity information;

the digital processing subsystem being arranged to compare the position and velocity information in real time to a local data store of information;

a local store of data incorporating a digital representation of municipal road segments with speed and position attributes;

the road segment attributes relating to road segment characteristics including, but not limited to, speed limits, pedestrian corridor locations, photo-enforced red light camera (RLC) locations, school zone locations, potentially hazardous road segment intersections exhibiting a high rate of collisions and injuries, and railway crossing locations;

a networking subsystem that allows the apparatus to be recognized as a Human Interface Device (HID) by external PCs; and a communication processing subsystem used to connect to a PC connected to the Internet or to a direct connection to the Internet to access a remote server with segmented database to provide for device and information updates and to provide for device personalization and configuration.

One embodiment of the invention will now be described in conjunction with the accompanying drawings in which:

BRIEF DESCRIPTION OF THE DRAWINGS

In the drawings like characters of reference indicate corresponding parts in the different figures.

DETAILED DESCRIPTION

Figure 1:
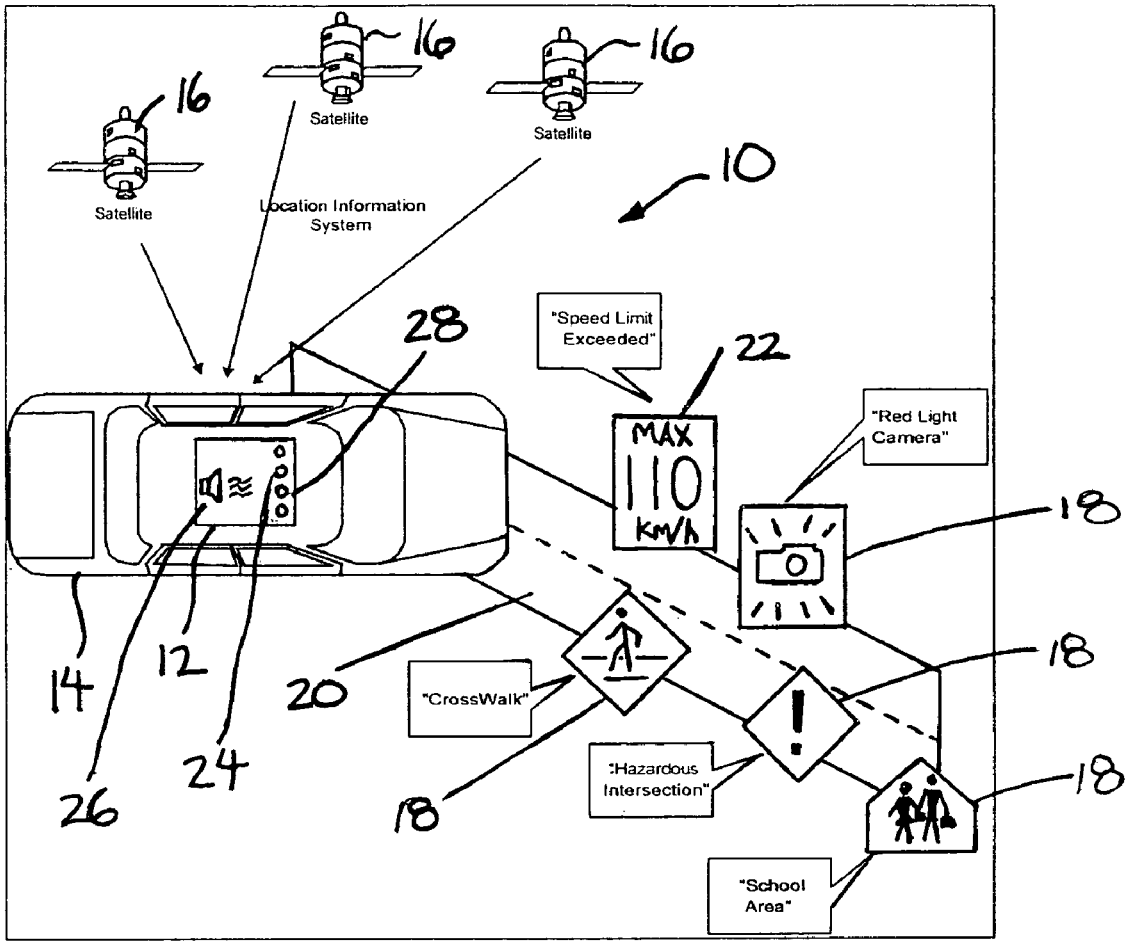
FIG. 1 is a schematic view of the environment in which the vehicle warning system operates.

Referring to the accompanying figures there is illustrated a vehicle warning system generally indicated by reference numeral 10. The system 10 is particularly suited for warning an operator of a vehicle of potentially unsafe conditions, for example when approaching an unsafe location or by exceeding the speed limit of a given roadway, in response to speed and position of the vehicle being determined by GPS information.

As shown in FIG. 1, the system is integrated within a housing 12 which is portable for being carried within a vehicle 14 to alert the operator of the vehicle of the potentially unsafe conditions. The housing receives its GPS information or any other location information system signals from satellites 16 in the environment of the system. The system keeps track of a plurality of given locations 18 represented within the system as location alert points. In addition actual road segments 20 and the regulated or posted speed limits 22 associated respectively therewith for a given coverage area are known to the system for determining certain alarm conditions as described further below.

An alarm condition is indicated to the operator by several types of indictors including LED lights 24 and one or more speakers 26. Components of the system are contained within the common plastic housing 12 which supports the LEDs and speaker thereon. Operator buttons 28 are also located on the housing for performing various functions as described further below.

Figure 3:
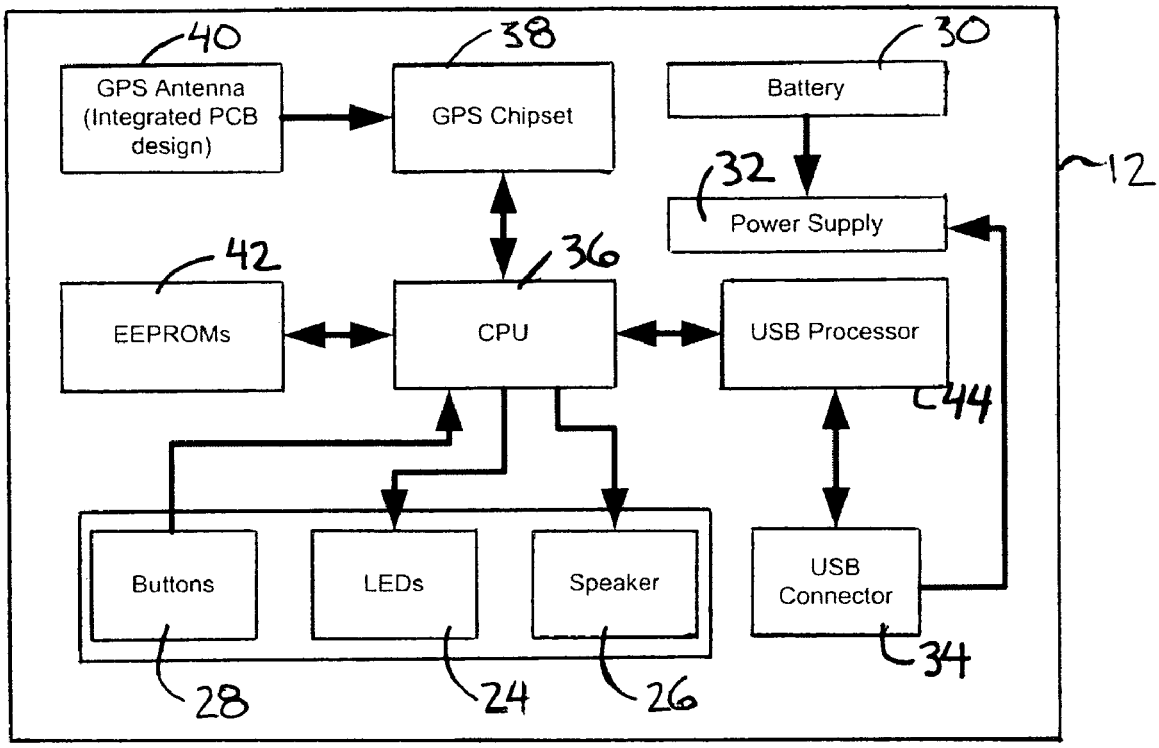
FIG. 3 is a schematic view of the components of the vehicle warning system.
Figure 4:
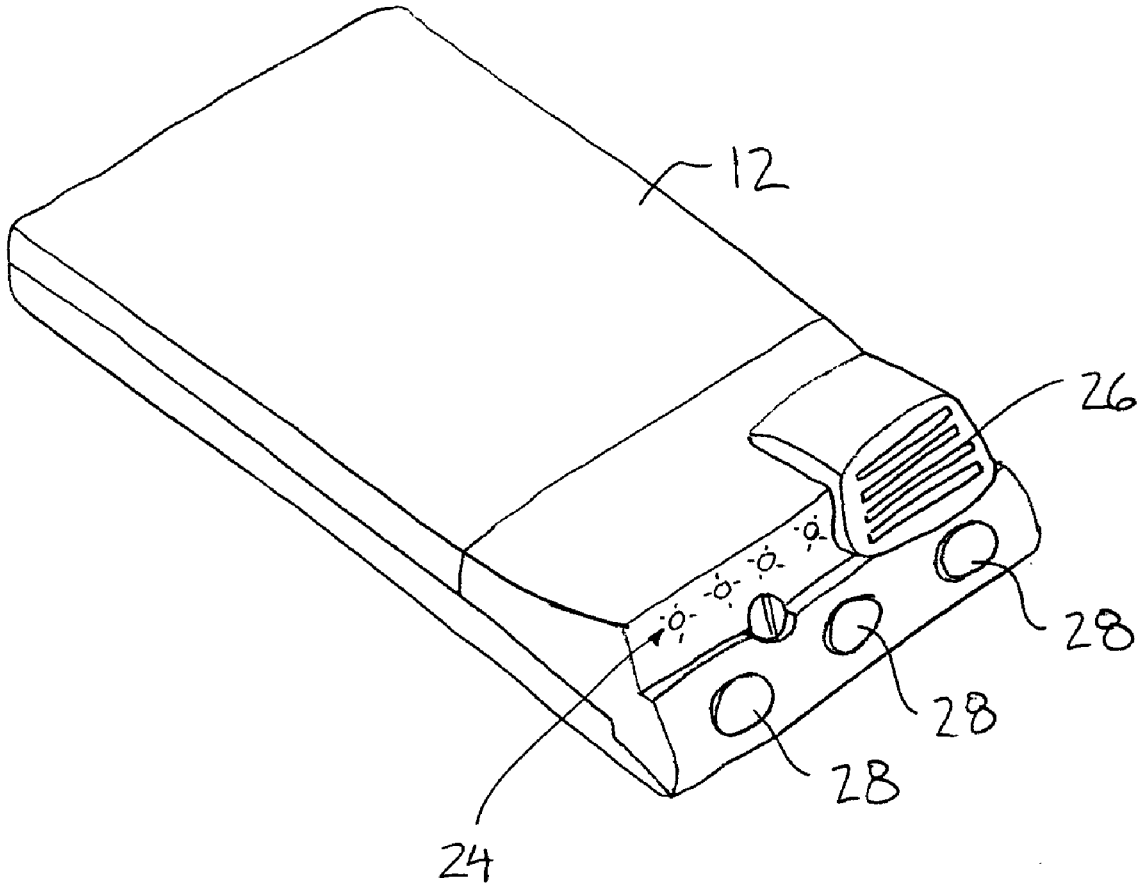
FIG. 4 is a perspective view of the housing supporting the components of the vehicle warning system therein.

Turing now to FIG. 3 the components of the system within the housing 12 are shown schematically. A battery 30 provides electrical power to the power supply 32 of the system. The power supply regulates electrical power to the components of the system. A USB connector 34 on the housing permits the components to be connected to an external device at which point the power supply may redirect its power input through the USB connector instead of consuming battery power.

An internal processor 36 controls the various functions of the system. The CPU processor 36 connects through a GPS or other location based system chipset to a GPS or other location based system antenna 40 which is of an integrated PCB design. The antenna receives the signals from the satellite or other location based system 16.

The processor 36 also connects to a local data storage 42 comprising EEPROM's which store all the information of the system therein. The information includes the location alert points which are each representative of a given location 18 having no speed data associated therewith and a plurality of road segment representations with speed data associated therewith which each represent an actual road segment of the coverage area along with the speed limit associated with that actual road segment 20. The information in the local data storage 42 is updated by the processor 36 through a USB processor 44 which connects by the USB connector to a remote server 46. The means of connection to the remote server 46 are described further below in relation to FIG. 2.

The processor 36 also connects to the indicators including the LED's 24 and the speakers 26 for outputting an alarm condition to alert the operator. The buttons 28 communicate with the processor 36 as inputs for modifying various functions of the system as described herein. Operating systems of the vehicle warning system 10 include an antenna subsystem for communication with the GPS antenna for capturing the location based information system signals. A radio frequency processing subsystem receives the signals from the antenna subsystem to determine a current position and a current velocity of the motor vehicle. The local data storage is updated with current information of location alert points and road segment representations with speed data associated therewith from the remote server 46 within a designated coverage area.

The processor can thus compare the current position and the current velocity as determined by the radio frequency processing subsystem to the local data storage to determine an alarm condition if the current position approaches a location alert point or if the current position corresponds to a location within the boundaries of one of the road segment representations and the current velocity exceeds the speed data associated therewith. The operator is then alerted of the alarm condition by the indicators.

A communication processing subsystem controls connection of the local storage data to the remote server to update the local data storage with information from the remote server. Each road segment representation is defined as two end points and a width so that a resulting area with a boundary is defined.

Substantially all continuous and intersecting road segment representations within the prescribed coverage area are represented, so that at any given time of vehicle operation, the processor determines within the boundaries of which road segment representation the current position of the vehicle corresponds with. At any time, one of the buttons 28 may be depressed by the operator to interrogate the local data storage for the speed limit associated with the road segment representation with which the current position corresponds with. The system continuously compares the current velocity to the speed limit with which the current position corresponds with to determine the alarm condition as noted above.

The remote server 46 includes segmented databases including separately defined coverage areas with each coverage area comprising a plurality of road segment representations which are representative of substantially all actual road segments within a prescribed municipal area. The communication processing subsystem permits a user to personalize the system by selecting which coverage area is to be stored within the local data storage as well as permitting the user to select which types of location alert points among a database of plural location alert points of the remote server are updated to the local data storage of the system. By permitting the user to select only certain packets of information which are required or desired by the user, the system can be greatly simplified as only a minimum required amount of memory storage and processing power are required for the system to operate effectively, thus lowering the cost to the consumer.

Among the indicators, the LED's 24 are provided in different distinct colours which can be separately and independently associated with different types of alarm conditions. The location alert points may be separated into categories, for example crosswalks or school zones, with the communication procession subsystem being arranged to permit an operator to select which individual colours or sounds generated by the speaker are associated with which type of location alert point or which type of alarm condition if it is desirable for speed violations to be alerted in a different manner to the operator.

Alarm conditions with regard to speed violations may also be customized into different types. Preferably the speed data associated with each road segment representation comprises a speed limit and an allowance range exceeding the speed limit by a certain percentage. Accordingly the processor may only determine an alarm condition if the current velocity exceeds the speed data including the allowance range or not. The allowance range is adjustable by user input. In addition a user may wish to activate a first type of alarm condition if the speed limit is exceeded and a second type of alarm condition if the speed limit plus the additional allowance range are exceeded.

Figure 2:
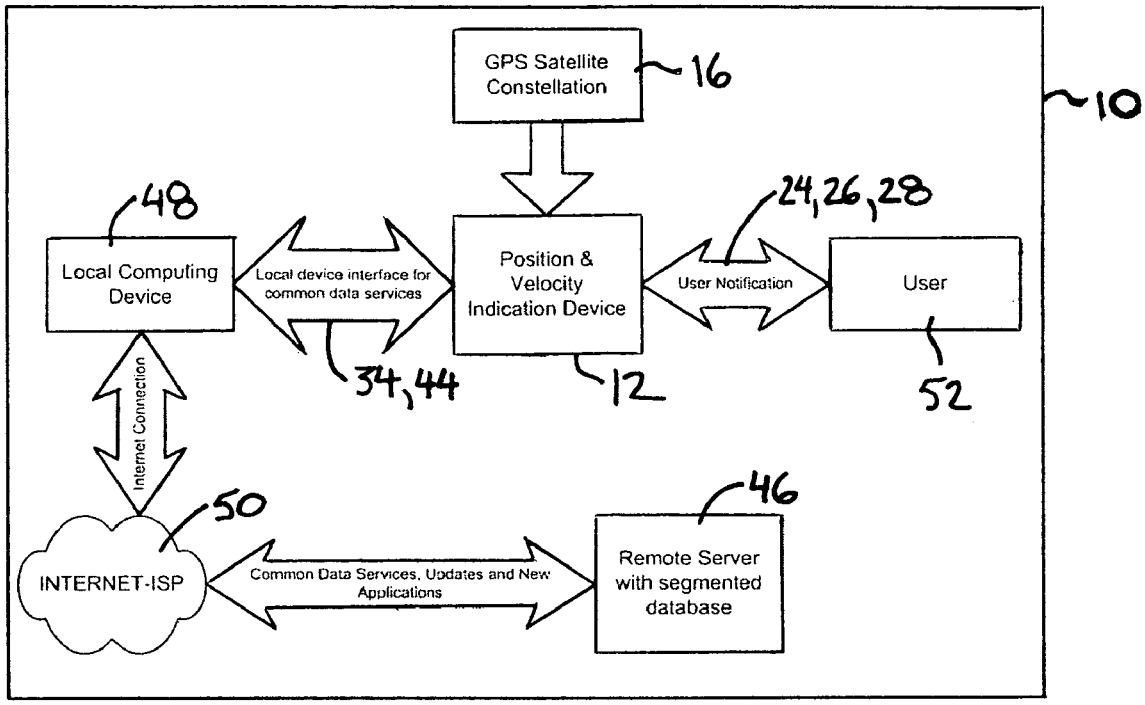
FIG. 2 is a schematic view of the operations performed by the vehicle warning system.

Updates are preformed by the communication processing subsystem by connection to a computing device 48 as shown in FIG. 2. The computing device permits connection to the Internet 50 which in turn communicates with the segmented database of the remote server 46 using common data services. The remote server includes a remote server application software tool that processes operator requests by automatically authenticating the communication processing subsystem through a connection management service that cross references an electronic serial number of the system and validates registration and common data services subscription for local data storage updates and personalization.

The various processes associated with the system 10 are shown in FIG. 2 in which the portable housing 12 is centrally illustrated for receiving location information system signals from the GPS satellites 16. Using the buttons 28 inputs are received from the user 52 and information is relayed back to the user through the indicators 24 and 26. The USB connectors operate in connection with local device interfaces for common data service to connect the components of the housing 12 to the local computing device 48. The local computing device 48 connects to the internet 50 in its conventional manner for relaying information back and forth to and from the remote server.

The memory storage 42 within the system 10 communicates with the processor in such a manner that a user log subsystem records a log of travel of the vehicle based on the current position and current velocity data as well as any events, such as alarm conditions. The user log subsystem is then arranged to communicate externally to permit a user to transfer the log in the form of the position and time related data collected to a personal software application tool for mapping and reposting statistics. In some embodiments, the communication processing subsystem is arranged to operate in a real time manner to continuously update the local data storage during operation of the vehicle by communicating in one of various manners including wireless techniques such a licensed analog FM frequencies, licensed digital radio frequencies and licensed or unlicensed wireless fidelity and Wi-MAX frequency spectra. The local data storage thus receives its updates from the remote server 46 through these wireless connection techniques.

Additional features of the system may include an audio output jack on the housing connected to the indicators which permits connection of an auxiliary speaker in addition to the primary speaker 26 to provide louder indications to the operator of the motor vehicle of the alarm condition in noisy environments, as in industrial applications for example. A photocell may be provided on the housing which provides input to the processor of an ambient light condition determined by the photocell. This information is used to automatically adjust a brightness of any LEDs 24 of the indictors in response to the ambient light conditions. When operating in brighter environments, for example brighter LEDs are desirable to be more visible.

The antenna subsystem, the radio frequency subsystem, the local data storage, the processor, the indictor, the power supply and the communication processing subsystem are preferably contained within a common portable housing operable on battery power. The processor is arranged to disconnect the power supply in response to the current position remaining unchanged for an elapsed period of time to conserve the battery power.

As described herein, the system 10 involves a highly integrated electronic device, a simple process for configuring and personalizing the device, and a remote computer server containing the management information database of municipal zones and points of interest. In reference to FIG. 1, the device will operate correctly in an environment that allows it to receive the GPS or other location based system signals from four or more satellites or location based system transmitters.

As described herein, in reference to FIG. 2, the device determines the position of the operator or the operator's vehicle through its GPS or location based system receiver, which identifies position based on latitude and longitude. The operator's position and velocity is constantly updated and compared with an on-board database of Location Alert Points (LAPs) and road segment representations with municipal speed zones associated therewith. Upon approaching a point of interest location, the device will alert the user of this situation by a sound and by a visual indicator. The device also calculates the velocity of the vehicle and will alert the user when the vehicle's speed exceeds the posted maximum speed limit.

Default LAPs and municipal road segments with speed zones are pre-loaded into the device based on the intended principal application that may include alerts to excessive speeding, Red Light Camera controlled intersections, school zones, crosswalks, railway crossings, distance and mileage counters for business applications, pre-programmed navigation points of interest, and other community or municipal points of interest. This information is contained within a management information database on a remote server and allows an operator with a valid device and subscription, or on a transactional basis, to configure and update the device automatically through a local computing device connected to the Internet;

The local computing device can be a Personal Digital Assistant (PDA) or any form of Personal Computers (PC) including desktop, tablet, pocket computer, or laptop computer. The local computing device interfaces to the remote server subsystem through an Internet connection and an existing web browser software application to retrieve information;

The device interfaces to the local computing device through a simple data connection, one that is automatically recognized by the operating system on the local computing device without the requirement for the user to install any specific application software. A transceiver element within the device provides such a connection in addition to a software element that communicates with the local device operating system according to standards-based protocols.

As described above, the principal components in the device are illustrated in FIG. 3 and consist of an integrated GPS or other location based system antenna subsystem, an RF signal processing subsystem, a general purpose microcontroller CPU (Central Processing Unit), EEPROM (electrically erasable programmable read-only memory) memory modules, user Interface elements consisting of a low cost speaker, simple push buttons, and high visibility LED's in different colors, a USB (universal serial bus) interface controller and USB connector, a high-efficiency voltage regulator and two AA batteries.

All components will be mounted on a multi-layered PCB (printed circuit board) with the exception of the GPS or other location based system receiver module, which will have its own PCB. The antenna will be integrated onto the same PCB or will have its own PCB, which sits above the main PCB at the top of the enclosure. The antenna will be connected to the RF input and to ground on the RF processing subsystem, with no other antenna interconnection required;

The serial input & output from the RF processing subsystem module will be connected to the USART (universal synchronous asynchronous receiver transmitter) on the CPU. The CPU will be connected to the EEPROM memory elements, the peripheral user interface elements, and to the USB interface controller. The USB interface controller will only be powered on when there is adequate supply voltage on the USB connector. When the device is running off batteries, the USB interface will consume no power;

Municipal information is derived from the most recent map data that includes road segment representations and community and municipal LAPs that are categorized according to road safety function. All road segment information is stored in the EEPROM memory elements. Each road segment representation is defined as two endpoints, a width, and a group of attributes including speed limit information. The attributes include the scaling factor of the offset data, as well as the type of road segment (speed limit change or point of interest). The road segments are stored in sorted order in the EEPROM in order to reduce the search time. A search through the road segments also takes two steps. The first step determines if the user is inside the large rectangle that contains the entire segment. If that step results in a match, then another comparison is performed. This one compares the resulting angles between the four corners of the road segment and the operator's current position.

The remote server subsystem involves a computing system that is in the form of a server computing device. The server subsystem can be a server workstation, a PC-based machine, or a distributed computing system and includes a management information database and an authentication, authorization and accounting server subsystem.

The remote server subsystem provides an operator with access to the information database, services operator requests through a connection management process that registers and/or identifies a valid device, validates a subscription or provides an alternative electronic commerce transaction, and handles exceptional events through a fault management process.

The device is pre-loaded with standard notification trigger settings, sounds, a default municipal zone, and default points of interest. With a valid subscription or via a transaction option, an operator can personalize the device for settings and for desired functionality via a single connection to reach the remoter server via a local computing device connected to the Internet.

The management information database is segmented according to configuration and functionality processes and the web server application will present the information accordingly. The device configuration allows the user to personalize specific settings and alert trigger points. Such settings include default volume setting, LED intensity, the number of meters or seconds prior to approaching a point of interest, and the number of kilometres per hour above the maximum posted speed limit prior to notification which is defined as the allowance range noted above.

The LAP positional information is further partitioned according to zone or coverage area selection and point of interest categories. Zones can be complete municipalities, communities within a municipality, towns, and or villages. Multiple zones will be available for downloading to the device depending on the user's requirements while traveling to different parts of the country and within North America. A user traveling to Calgary, Alberta, Canada on business, for example, could download the Calgary zone or coverage area and the desired points of interest and/or municipal speed zones;

LAP positional data will be available for each zone according to categories that may include red light camera controlled intersections, school zones, crosswalks, railroad crossings, community-identified safety locations, custom locations for specific commercial applications, and other desirable road safety location determination information.

Location Alert Point (LAP) information can be downloaded to the device in a real-time manner through the server subsystem using a wireless network. Such information includes relevant and timely location data related to road safety applications, and is superimposed on the road segment network resident within the local storage in the device.

The local data storage is pre-loaded with default sounds and tones that can be personalized by accessing the catalogue on the remote server. A valid device with a valid subscription allows the operator to preview sounds, select a new sound, and then automatically download the sound to the device for the desired alert function.

The remote server system will also provide the user with the ability to mark geographic positions "on-the-fly" in real-time, as well as pre-load personal points of interest through the presentation of a zone map. Such positional information can alert the driver as a simple form of navigational assistance with the appropriate sounds and flashing lights. Information about the journey, such as mileage, time or recording of specific driving behaviour events such as speeding, can be stored on the device and later uploaded to a remote server log for review.

The system is pre-loaded with the speed limits for the road segments within the municipal coverage area and alerts the user if the speed limit is being exceeded. The road segment speed limit attributes correspond to the restricted speed legislation as specified by the Municipal, Provincial, State, or Federal traffic authority.

The system includes a network connection mounted in the housing to allow for connection to an external network and a networking subsystem that allows the apparatus to be recognized as a HID (Human Interface Device) by computing devices, which alleviates the need for an apparatus-specific device driver.

The audio output mounted in the housing allows connection to an external loud speaker. Manual control mounted in the housing allows the operator to mark positional coordinates for data logging, to adjust the volume of the output sounds, to power the device on and off, and to interrogate the device for road safety information, including the speed limit corresponding to the current position.

The aural notification of the indicator can be a sound or voice prompt, the voice prompt being presented in the operator's preferred language.

The indicator includes LEDs which consist of multiple and distinct colors, each color being associated with a specific Location Alert Point notification that can be personalized by the operator. The photocell of the housing automatically adjusts the brightness of the LEDs under device software control.

The system will automatically power down under device software control to conserve battery life if the digital processing subsystem does not detect a change in the operator's vehicle position over a specified period of time.

The system will update its position and velocity at a rate of at least one time per second to meet operational parameters based on vehicle distance to the Location Alert Points (LAPs) and the speed of the Operator's vehicle.

In summary, the position and velocity indication system involves an integrated electronic device encompassing a GPS or other location based system receiver, a simple means of alerting an operator of a vehicle of an approaching location alert point (LAP), a single connection to the device used to provide power and to update the internal management information base of municipal data, and a simple configuration and programming process used to access a database of municipal zones and LAP categories. The solution also requires very minimal electronic device programming knowledge.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. A vehicle warning system responsive to speed and position of the vehicle, the system comprising:

an antenna subsystem arranged for capturing location based information system signals;

a radio frequency processing subsystem which is arranged to receive the signals from the antenna subsystem to determine a current position and a current velocity of the motor vehicle;

a local data storage including location alert points and road segment representations with speed data associated therewith, the location alert points each being representative of a given location, and the road segment representations with speed data associated therewith each being representative of an actual road segment and a speed limit for the actual road segment;

a processor which is arranged to compare the current position and the current velocity determined by the radio frequency processing subsystem to the local data storage to determine an alarm condition if the current position approaches a location alert point or if the current position corresponds with one of the road segment representations and the current velocity exceeds the speed data associated therewith;

an indicator arranged to alert an operator of the motor vehicle of the alarm condition;

a power supply arranged for supplying electrical power to the system;

the power supply being arranged to be disconnected such that the system is automatically powered down under software control in response to the current position remaining unchanged for an elapsed period of time;

a communication processing subsystem arranged for connecting the local storage data to a remote server to update the local data storage.

2. The system according to claim 1 wherein the remote server comprises a database of location alert points stored according to a plurality of different categories; and the remote server comprises a selection tool arranged to permit a user to select which categories of location alert points among the database of location alert points of the remote server are updated to the local data storage by the communication processing subsystem.

3. The system according to claim 1 wherein the location alert points have no speed data associated therewith.

4. The system according to claim 1 wherein each road segment representation is defined as two endpoints and a width.

5. The system according to claim 1 wherein the local data storage includes a plurality of continuous and intersecting road segment representations which represent the actual road segments within a prescribed area.

6. The system according to claim 5 wherein substantially all actual road segments within the prescribed area are represented in the local data storage by a road segment representation.

7. The system according to claim 6 wherein all actual road segments within the prescribed area having a posted or a legislated speed limit associated therewith are represented in the local data storage by a road segment representation.

8. The system according to claim 1 wherein the remote server includes a plurality of coverage areas, each coverage area comprising a plurality of road segment representations which are representative of substantially all actual road segments in a prescribed municipal area and wherein the communication processing subsystem permits a user to select which coverage area is stored in the local data storage.

9. The system according to claim 1 wherein the communication processing subsystem permits a user to select which location alert points, among a database of location alert points of the remote server, are updated to the local data storage.

10. The system according to claim 1 wherein there is provided a plurality of types of indicators and wherein the communication processing subsystem permits a user to select which indicator is associated with each alarm condition.

11. The system according to claim 10 wherein the plurality of types of indicators includes LED lights of different colours.

12. The system according to claim 1 wherein the speed data comprises a speed limit and an allowance range exceeding the speed limit by a prescribed percentage and wherein the processor only determines an alarm condition if the current velocity exceeds the speed data including the allowance range exceeding the speed limit by the prescribed percentage, the allowance range being adjustable.

13. The system according to claim 1 wherein the communication processing subsystem is arranged to connect to a computing device connected to the internet or to connect directly to the Internet to access the remote sever and wherein the remote server includes a segmented database to provide for local data storage update and to provide for personalization and configuration of various system settings.

14. The system according to claim 1 wherein the remote server includes a remote server application software tool that processes operator requests by automatically authenticating the communication processing subsystem through a connection management service that cross-references an electronic serial number of the system and validates registration and common data services subscription for local data storage updates, personalization, and category selection of location alert points.

15. The system according to claim 1 wherein there is provided a user log subsystem which records a log of travel of the vehicle and alarm conditions, the user log subsystem being arranged to permit a user to transfer the log in a form of position and time related data to a personal software application for mapping and reporting statistics.

16. The system according to claim 1 wherein the communication processing subsystem is arranged to initiate, receive, and operate in a mobile, real-time manner using wireless techniques including one of licensed analog FM (Frequency Modulation) frequencies, licensed digital radio frequencies, and licensed and unlicensed Wireless-Fidelity (Wi-Fi) and Wi-MAX frequency spectra.

17. The system according to claim 1 wherein there is provided a user input arranged for interrogating the local data storage for the speed limit associated with a road segment representation with which the current position corresponds with responsive to a user contacting the user input such that the speed limit is relayed back to the user through the indicator.

18. The system according to claim 1 wherein the indicator includes a primary speaker and an auxiliary output for connection to an auxiliary speaker to alert the operator of the motor vehicle of the alarm condition.

19. The system according to claim 1 wherein there is provided a photocell for determining ambient light condition, the indicator including a light having a brightness which is in response to the ambient light condition determined by the photocell.

20. The system according to claim 1 wherein the integrated antenna subsystem, the radio frequency processing subsystem, the local data storage, the processor, the indicator, the power supply, and the communication processing subsystem are contained within a common portable housing.

* * * * *